US005977053A

United States Patent [19]

Groth et al.

[11] Patent Number: 5,977,053

[45] **Date of Patent: *Nov. 2, 1999**

[54] DETERGENTS AND CLEANERS CONTAINING IMINODISUCCINATES

[75] Inventors: Torsten Groth, Odenthal; Winfried Joentgen, Köln; Hans-Joachim Traenckner, Leverkusen, all of Germany

[73] Assignee: Bayer AG, Leverkusen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/653,000

[22] Filed: May 24, 1996

[30] Foreign Application Priority Data

Jul. 31, 1995 [DE] Germany ..... 195 28 059

[51] Int. Cl.[6] ..... C11D 3/32; C11D 3/37

[52] U.S. Cl. ..... 510/480; 510/488; 510/501

[58] Field of Search ..... 510/476, 480, 510/488, 501

[56] References Cited

U.S. PATENT DOCUMENTS

| | | |
|---|---|---|
| 3,697,461 | 10/1972 | Troeger et al. . |
| 4,839,461 | 6/1989 | Boehmke . |
| 4,919,845 | 4/1990 | Vogt et al. . |
| 4,992,463 | 2/1991 | Tjoeng et al. . |
| 5,168,884 | 12/1992 | Baldwin et al. . |
| 5,266,237 | 11/1993 | Freeman et al. . |
| 5,288,783 | 2/1994 | Wood . |
| 5,318,726 | 6/1994 | Rossmaier et al. . |
| 5,362,412 | 11/1994 | Hartman et al. . |
| 5,371,180 | 12/1994 | Groth et al. . |

FOREIGN PATENT DOCUMENTS

| | | |
|---|---|---|
| 509382 A2 | 10/1992 | European Pat. Off. . |
| 513948 A2 | 11/1992 | European Pat. Off. . |
| 0 592 265 | 4/1994 | European Pat. Off. . |
| 0 612 842 | 8/1994 | European Pat. Off. . |
| 37 39 610 | 6/1989 | Germany . |
| 43 11 440 | 10/1994 | Germany . |
| 05-287685 | 11/1993 | Japan . |
| 05-287690 | 11/1993 | Japan . |
| 05-302289 | 11/1993 | Japan . |
| WO 94/10282 | 5/1994 | WIPO . |

OTHER PUBLICATIONS

Paladanini et al., Seifen, Öle, Fette, Wachse, 115 (1989). (German only).

K. Harada, J. Org. Chem. 24:1662–1666 (1959).

J. Kovacs et al., J. Org. Chem. 26:1084 (1961).

*Primary Examiner*—Yogendra Gupta

*Assistant Examiner*—John R. Hardee

*Attorney, Agent, or Firm*—Connolly Bove Lodge & Hutz LLP

[57] ABSTRACT

The combination comprising iminodisuccinates of the formula

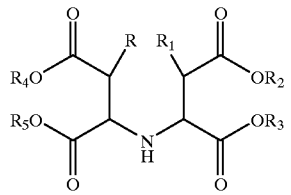

in which the substituents have the meaning given in the description and polymers containing recurring succinic acid units improve the properties of detergents or cleaners.

6 Claims, No Drawings

DETERGENTS AND CLEANERS CONTAINING IMINODISUCCINATES

The invention relates to combinations of iminodisuccinate derivatives and polymers containing recurring succinyl units and to detergents or cleaners containing this combination.

The development of novel detergent builders has been affected over the last years by the increasing use of phosphate-free detergents. In practice, the phosphate substitutes used are in particular zeolites, layer silicates, and mixtures of zeolites with alkali metal silicates, alkali metal carbonates and polymeric polycarboxylates. In addition, complexing agents, such as salts of nitrilotriacetic acid (NTA), ethylenediaminetetraacetic acid (EDTA) and phosphonic acids, for example HEDP, are also used. The purpose of these complexing agents, which in most cases act selectively, is to remove heavy metal ions, which adversely affect the washing process (see Ullmann 1987, Vol. 8/3 (351–354) and to counteract scale deposits and greying of the fabric, which are due to sparingly soluble calcium salts (M. Paladanini, G. Schnorbus, in Seifen-Öle-Fette-Wachse, 115, 508–511 (1989)).

EP-A-291,869 describes phosphate-free builder combinations comprising polymeric polycarboxyl ate, aminoalkanepolyphosphonate, 1-hydroxyethane-1,1-diphosphonate (HEDP) and zeolite, specific weight ratios of the first three compounds making it possible to achieve a synergistic prevention of scale deposits on the fiber.

DE-A-4,024,552 describes detergents and cleaners which consist of a combination of 3-hydroxy-2,2'-iminodisuccinic acid, soluble salts thereof and zeolite and are said to possess a high complexing power for alkaline earth metal ions and heavy metal ions. The compositions contain 0.01% by weight to 20% by weight of 3-hydroxy-2,2'-iminodisuccinic acid, 5 to 50% by weight of zeolite and 30% of a polymeric polycarboxylate. DE-A-4,311,440 likewise discloses phosphate-free builder systems for detergents and cleaners which, apart from 15 to 60% of zeolite, contain 1 to 30% by weight of 3-hydroxy-2,2'-iminodisuccinic acid or salts thereof and 1 to 20% by weight of amorphous and/or crystalline silicates.

U.S. Pat. No. 3,697,453 describes a phosphate-free detergent and cleaner which contains iminosuccinic acid and/or a water-soluble salt thereof as builder. The iminosuccinic acid content of the detergent is 10 to 50% by weight.

DE-A-3,739,610 discloses the preparation of 3,3'-dihydroxy-2,2'-iminodisuccinic acid and its use as complexing agent for alkaline earth metals in detergents and cleaners.

EP-A-256,366 (=U.S. Pat. No. 4,839,461) furthermore discloses the use of polyaspartic acid for removing and preventing scale deposits caused by water hardening agents.

EP-A-454,651 and EP-A-612,842 describe the use of polyaspartic acid in builder systems of phosphate-free detergents in combination with zeolites. Polyaspartic acid is used here as co-builder substitute for polymeric polycarboxylates.

With a view to the continuously rising requirements of detergents and cleaners, the object of the invention was to provide detergents and substances suitable for use as detergents which show improved biodegradability and technical performance.

The present invention provides a composition comprising at least one polymer containing recurring succinyl units and/or soluble salts thereof and an imino-disuccinate especially of the formula

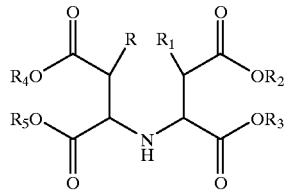

in which

R, $R_1$, independently of one another, denote H or OH, $R_2$, $R_3$, $R_4$, $R_5$, independently of one another, denote a cation, hydrogen, alkali metal ions and ammonium ions, ammonium ions having the general formula $R_6R_7R_8R_9N^+$ and $R_6$, $R_7$, $R_8$, $R_9$, independently of one another, denoting hydrogen, alkyl radicals having 1 to 12 C atoms or hydroxyl-substituted alkyl radicals having 2 to 3 C atoms.

Preferred polymers containing recurring succinyl units have at least one of the following optionally recurring structural units:

A1

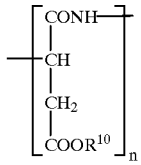

α

B1

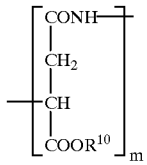

β

I

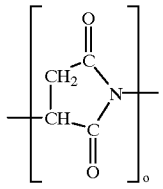

A2

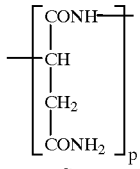

α

B2

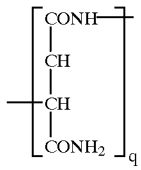

β

-continued

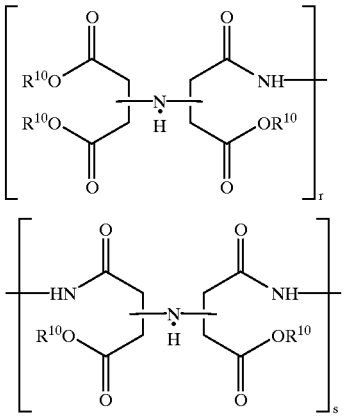

to which the following applies:

$R^{10}$ is H or a cation, in particular an alkali metal or ammonium, n, m, o are 0 or an integer from 1 to 300, p, q are 0 or an integer from 1 to 10, r is 0 or an integer of 1 or 2, s is 0 or an integer from 1 to 10, n+m+o+p+q≦300, the indices n, m, o, p, q, r and s indicating how many units, randomly or non-randomly distributed, are present in the polymer.

The polymers to be used according to the invention are understood to mean the corresponding free acids, their salts, but also derivatives of the acids, in particular anhydrides, amides and esters.

In a particularly preferred embodiment, the recurring unit B1 is present in an amount of at least 50%, in particular of at least 70%, relative to the sum of units B1 and A1.

The polyaspartic acids according to the invention also include those which have been chemically modified under the chosen reaction conditions compared with the corresponding starting compounds.

The average molecular weight (Mw) can vary over a wide range, useful polyaspartic acids being those having molecular weights between 500 and 100,000 g/mole, but preference being given to 1000 to 50,000 g/mole or, even better, 1000 to 30,000 g/mole.

The molecular weight is determined by gel permeation chromatography (GPC) on Shodex OH-PAK Column using 0.15 m NaCl+200 ppm $NaN_3$ as eluent solution. Calibration can best be carried out with pure polyaspartic acid, for example from Sigma, whose molecular weight was determined by an absolute measuring method, for example LALLS.

In addition, a suitable reaction procedure and selection of the educts can lead to the presence of still further recurring units, for example a) malic acid units of the formulae

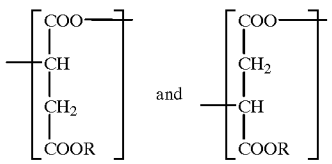

and b) maleic acid and fumaric acid units of the formulae

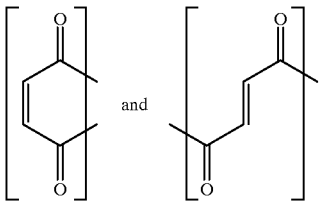

The invention furthermore provides detergents and/or cleaners containing, in particular as builder, the combination according to the invention comprising an iminodisuccinate derivative and a polymer having recurring succinyl units. The weight ratio of the polymers having recurring succinyl units to the iminodisuccinate derivative is preferably between 1:6 and 2:1.

In a preferred embodiment, the polymers to be used according to the invention having recurring succinyl units are essentially polyaspartic acids. The polymers can be prepared by known methods, for example in accordance with U.S. Pat. No. 4,839,461, U.S. Pat. No. 5,371,180, U.S. Pat. No. 5,288,783, J. Org. Chem., 24, p. 1662–1666 (1959) and J. Org. Chem., 26, 1084 (1961).

Phosphate-free detergents and cleaners containing the builder system according to the invention show good primary washing power and improved secondary washing power in combination with reduced scale deposits and increased whiteness of the fabric. Accordingly, the invention also provides a phosphate-free detergent and cleaner preferably containing, as builders, 0.5 to 40% by weight of an iminodisuccinate derivative of structure A and, preferably, 0.5 to 25% by weight of a polymer containing recurring succinic acid units.

If desired, 1 to 40% by weight of zeolite and/or amorphous and/or crystalline alkali metal silicates can additionally be present.

The builder system according to the invention exhibits very good complexing power for alkaline earth metal ions and the heavy metal ions which interfere in the washing process and high dispersing power for dirt particles and a growth-inhibiting effect on already formed alkaline earth metal salt microcrystallites (crystallization seeds). These properties also have a positive effect on the stabilization of bleaches and enzymes.

Apart from its good washing performance, the builder system also shows easy biodegradability, since, apart from the inorganic components, it only contains iminodisuccinate derivatives of structure A and polyaspartic acids, which, according to the OECD guidelines for testing chemicals (1981), exhibit good biodegradability.

Although the detergents and cleaners according to the invention can additionally contain further customary builders and complexing agents, for example phosphonates and polycarboxylates, such as adipic acid, succinic acid, glutaric acid, aminocarboxylic acids, nitriloacetic acid (NTA), ethylenediaminetetraacetic acid (EDTA), which are preferably used in the form of their sodium salts, as long as ecological considerations do not prohibit such a use, and mixtures of these acids and (co)polymeric polycarboxylic acids or polycarboxylates, they are not necessary for improving the secondary washing power. Accordingly, for the purposes of this invention, they do not have to be included.

The addition of polyhydroxycarboxylic acid salts, such as citric acid and citrate, helps to remove bleachable stains. Accordingly, detergents and cleaners according to the invention can, if desired, contain up to 20% by weight of sodium citrate, in particular 0.5 to 15% by weight of sodium citrate.

Of the iminodisuccinic acid derivatives used in the builder system according to the invention, preferably the soluble salts are used. They are those in which the cations present are those from the group consisting of ammonium ions and alkali metal ions. In these iminodisuccinic acids, one, two, three or all four carboxylic acid groups can be present in salt form.

Of the polymers to be used according to the invention, the water-soluble alkali metal salts or the polysuccinimides partially hydrolyzed with alkali metal should preferably be used.

The zeolites, if used, are employed in the customary hydrated, finely crystalline form. Preferably, their water content is between 19 and 22% by weight. They contain virtually no particles greater than 30 $\mu$m and preferably at least 80% of their particles are less than 10 $\mu$m in size. Their calcium binding power, as determined by the method of German Patent Application 2,412,837, is in the range from 100 to 200 mg CaO/g. A particularly suitable zeolite is zeolite NaA, further suitable zeolites including zeolite NaX and mixtures of NaA and NaX. As used in this invention, amounts and weight ratios given for the builder zeolite are based on anhydrous active substance, unless stated otherwise.

The solid silicates can be amorphous and/or crystalline. They can be used as powders or as granules. Preferred alkali metal silicates are the sodium silicates, in particular the amorphous sodium silicates having an $Na_2O/SiO_2$ molar ratio of 1:2 to 1:2.8. Amorphous alkali metal silicates of this type are commercially available, for example, under the name of Portil (Henkel). The crystalline silicates used, which can be present on their own or in a mixture with amorphous silicates, are preferably crystalline layer silicates of the formula (I) $NaMSixO_2+1xyH_2O$, in which M represents sodium, x adopts the values 2 or 3, and y is 0 to 20. Particular preference is given not only to β- but also to the δ-form of sodium disilicates $Na_2Si_2O_5$. The layer silicates SKS 6 and SKS 7 from Hoechst should be mentioned here by way of example. In addition, the builder combinations according to the invention can contain sodium carbonate as alkali reserve. However, it is preferred to reduce the sodium carbonate content compared with customary phosphate-free detergents, since the components according to the invention (polyaspartic acid/iminodisuccinic acid derivatives) themselves exhibit a buffering effect and, accordingly, also give rise to a certain alkali reserve.

The combinations according, to the invention can additionally contain further components, for example inorganic salts, in particular those giving a neutral reaction. However, it is particularly preferred that the combinations have been sprayed with components ranging from liquids to waxes, for example silicone oils and paraffin oils, but preferably with nonionic surfactants.

Apart from the ingredients mentioned, the compositions according to the invention can contain known additives commonly used in detergents and cleaners, for example surfactants, bleaches and bleaching activators, salts giving a basic reaction with water, solubility-improving agents, such as customary hydrotropes or polyalkylene glycols, for example polyethylene glycols, foam inhibitors, fluorescent whitening agents, enzymes, enzyme stabilizers, small amounts of neutral filler salts, and colorants and scents, opacifiers or pearl luster agents.

The anionic and nonionic surfactant, including soap, content of the compositions is preferably 10 to 35% by weight, advantageously 12 to 28% by weight, and in particular 15 to 25% by weight.

Surfactants of the sulfonate type preferably include $C_5$–$C_{13}$-alkylbenzenesulfonates, olefinsulfonates, i.e. mixtures of alkene- and hydroxyalkanesulfonates and disulfonates, such as are obtained, for example, from $C_{12}$–$C_{18}$-monoolefins having a terminal or inner double bond by sulfonation with sulfur trioxide gas, followed by alkaline or acid hydrolysis of the sulfonation products. Alkanesulfonates obtained from $C_{12}$–$C_{18}$-alkanes, for example by sulfochlorination or sulfoxidation, followed by hydrolysis or neutralization, are also suitable. In these products, the sulfonate group is randomly distributed over the entire carbon chain, and the secondary alkanesulfonates predominate. Esters of α-sulfo fatty acids (ester sulfonates), for example the α-sulfonated methyl esters of the hydrogenated coconut, palm kernel or tallow fatty acids, are also suitable. Suitable compounds are in particular esters of α-sulfo fatty acids (ester sulfonates) prepared by α-sulfonation of the methyl esters of fatty acids of vegetable and/or animal origin having 8 to 20 C atoms in the fatty acid molecule, followed by neutralization, to give the water-soluble monosalts. They are preferably the α-sulfonated esters of the hydrogenated coconut, palm kernel or tallow fatty acids, the presence of sulfonation products of unsaturated fatty acids, for example oleic acid, in small amounts, preferably in amounts of not more than about 2 to 3% by weight, also being possible. Preference is given, in particular, to alkyl esters of α-sulfo fatty acids containing an alkyl chain of not more than 4 C atoms in the ester group, for example methyl esters, ethyl esters, propyl esters and butyl esters. It is particularly advantageous to employ the methyl esters of α-sulfo fatty acids (MES). Further suitable anionic surfactants are α-sulfo fatty acids or disalts thereof which are obtainable by ester cleavage of α-sulfo fatty acid alkyl esters. The monosalts of α-sulfo fatty acid alkyl esters are already obtained as an aqueous mixture containing limited amounts of disalts during their large-scale preparation. The disalt content of such surfactants is usually below 50% by weight, for example up to about 30% by weight, relative to the anionic surfactant mixture. Mixtures of monosalts and disalts with other surfactants, for example with alkylbenzenesulfonate or alkyl sulfates, are preferred.

Further suitable anionic surfactants are sulfonated fatty acid glycerol esters. Fatty acid glycerol esters are understood as meaning mono-, di- and triesters and mixtures thereof, such as are obtained during synthesis by esterification of 1 to 3 mol fatty acid with a monoglycerol or by reacting triglycerides with 0.3 to 2 mol of glycerol. Of these, preferred sulfonated fatty acid glycerol esters are the sulfonation products of saturated fatty acids having 6 to 22 carbon atoms, for example of caproic acid, caprylic acid, capric acid, myristic acid, lauric acid, palmitic acid, stearic acid or behenic acid. If the starting materials are fats and oils, i.e. natural mixtures of different fatty acid glycerol esters, it is necessary to substantially saturate the feed materials in a manner known per se with hydrogen prior to sulfonation, that is, to hydrogenate them to iodine numbers of less than 5, advantageously of less than 2. Typical examples of suitable feed materials are palm oil, palm kernel oil, palm stearine, olive oil, rapeseed oil, coriander oil, sunflower oil, cottonseed oil, peanut oil, linseed oil, lard oil or pig fat. However, owing to their high natural content of saturated fatty acids, the use of coconut oil, palm kernel oil or beef fat as the starting materials has proven particularly advantageous. Sulfonation of the saturated fatty acids having 6 to 22 carbon atoms or of the mixtures of fatty acid glycerol esters having iodine numbers of less than 5, which contain fatty acids having 6 to 22 carbon atoms, is preferably carried out by reaction with sulfur trioxide gas, followed by neutralization with aqueous bases, as described in the International Patent Application WO 91/9009.

The sulfonation products constitute a complex mixture containing mono-, di- and triglyceridosulfonates having a sulfo moiety in the α and/or in an inner position. The by-products formed are sulfonated fatty acid salts, glyceridosulfates, glycerol sulfates, glycerol and soaps. If sulfonation is started with saturated fatty acids or mixtures of hydrogenated fatty acid glycerol esters, the proportion of α-sulfonated fatty acid disalts can be quite easily as high as about 60% by weight, depending on how the process is run.

Suitable surfactants of the sulfate type are sulfuric monoesters of primary alcohols of natural and synthetic origin. Preferred alk(en)yl sulfates are the sulfuric monoesters of $C_{12}$–$C_{18}$ fatty alcohols, for example of coconut fatty alcohol, tallow fatty alcohol, lauryl alcohol, myristyl alcohol, cetyl alcohol and stearyl alcohol or $C_{10}$–$C_{20}$-oxoalcohols and those of the secondary alcohols having this chain length. Further preference is given to alk(en)yl sulfates having the chain length mentioned and containing a synthetic straight-chain alkyl radical prepared on the basis of petrochemicals, which sulfates have an analogous degradation behavior as the corresponding compounds based on fat chemical raw materials. For washing purposes, $C_{16}$–$C_{18}$-alk(en)yl sulfates are particularly preferred. It may also be particularly advantageous, and especially for machine detergents, to use $C_{16}$–$C_{18}$-alk(en)yl sulfates in combination with anionic surfactants of lower melting points and, in particular, with those anionic surfactants having a lower Krafft point and showing reduced crystallization tendency at relatively low washing temperatures of, for example, room temperature up to 40° C. Accordingly, in a preferred embodiment of the invention, the compositions contain mixtures of short-chain and long-chain fatty alkyl sulfates, preferably mixtures of $C_{12}$–$C_{14}$ fatty alkyl sulfates or $C_{12}$–$C_{16}$ fatty alkyl sulfates with $C_{16}$–$C_{18}$ fatty alkyl sulfates. However, in a further preferred embodiment of the invention, not only saturated alkyl sulfates but also unsaturated alkenyl sulfates having an alkenyl chain length of, preferably, $C_{16}$–$C_{22}$ are used. Of these, preference is given in particular to mixtures of saturated sulfonated fatty alcohols, predominantly consisting of $C_{16}$ fatty alcohols, and unsaturated sulfonated fatty alcohols, predominantly consisting of $C_{18}$ fatty alcohols. The alkenyl sulfate/alkyl sulfate weight ratios are preferably 10:1 to 1:2 and, in particular, about 5:1 to 1:1.

Sulfuric monoesters of straight-chain or branched $C_7$–$C_{21}$-alcohols ethoxylated with 1 to 9 mol of ethylene oxide, such as branched 2-methyl-$C_9$–$C_{11}$-alcohols containing on average 3.5 mol of ethylene oxide (EO) or $C_{12}$–$C_{18}$ fatty alcohols containing 2 to 4 EO are also suitable. Owing to their extensive foaming, they are used in detergents only in relatively small amounts, for example in amounts of 1 to 5% by weight.

Preferred anionic surfactants also include the salts of alkylsulfosuccinic acid, which are also referred to as sulfosuccinates or as sulfosuccinic esters, and are the monoesters and/or diesters of sulfosuccinic acid with alcohols, preferably fatty alcohols, and, in particular, ethoxylated fatty alcohols. Preferred sulfosuccinates contain $C_8$–$C_{18}$ fatty alcohol radicals or mixtures thereof. Especially preferred sulfosuccinates contain a fatty alcohol radical derived from ethoxylated fatty alcohols, which, when regarded by themselves, constitute nonionic surfactants (for their description, see below). Of these, again the sulfosuccinates whose fatty alcohol radicals are derived from ethoxylated fatty alcohols having a narrowed distribution of homologues are particularly preferred. Likewise, it is also possible to use alk(en)ylsuccinic acid preferably having 8 to 18 carbon atoms in the alk(en)yl chain or salts thereof.

Preferred granular detergents or cleaners contain alkylbenzenesulfonates and/or alkyl sulfate, preferably fatty alkyl sulfate, and/or sulfonated fatty acid glycerol esters, as the anionic surfactants, the weight ratio of the sulfonated fatty acid glycerol esters to the alkylbenzenesulfonate and/or the alkyl sulfate being 1:9 to 4:1, in particular 2:5 to 2:1.

Further anionic surfactants include in particular soaps, preferably in amounts of 0.2 to 8, and in particular of 0.5 to 5, % by weight. Suitable soaps include fatty acid soaps, such as the salts of lauric acid, myristic acid, palmitic acid or stearic acid, and, in particular, soap mixtures derived from natural fatty acids, for example coconut, palm kernel or tallow fatty acids. Preference is given in particular to those soap mixtures composed of 50 to 100% by weight of saturated $C_{12}$–$C_{18}$ fatty acid soaps and 0 to 50% by weight of oleic acid soap.

The anionic surfactants can be present in the form of their sodium salts, potassium salts or ammonium salts and as soluble salts of organic bases, such as mono-, di- or triethanolamine. The anionic surfactants are preferably present in the form of their sodium salts or potassium salts, in particular in the form of their sodium salts.

In a further preferred embodiment, the granular detergents or cleaners also contain, in addition to anionic surfactants, nonionic surfactants, preferably in amounts of 1 to 15% by weight, in particular in amounts of 2 to 12% by weight.

The nonionic surfactants used are preferably alkoxylated, advantageously liquid ethoxylated, in particular primary alcohols preferably having 9 to 18 C atoms and on average 1 to 12 mol of ethylene oxide (EO) per mole of alcohol, in which the alcohol radical can be linear or, preferably, methyl-branched in the 2 position, or can contain linear radicals or radicals methyl-branched in a mixture, such as are usually present in oxo alcohol radicals. However, particular preference is given to alcohol ethoxylates having linear radicals of alcohols of native origin containing 12 to 18 C atoms, for example of coconut, tallow fatty or oleyl alcohol, and on average 2 to 8 EO per mole of alcohol. The preferred ethoxylated alcohols include, for example, $C_{12}$–$C_{14}$-alcohols containing 3 EO or 4 EO, $C_9$–$C_{11}$-alcohols containing 7 EO, $C_{13}$–$C_{15}$-alcohols containing 3 EO, 5 EO, 7 EO or 8 EO, $C_{12}$–$C_{18}$-alcohols containing 3 EO, 5 EO or 7 EO and mixtures thereof, such as mixtures of $C_{12}$–$C_{14}$-alcohol containing 3 EO and $C_{12}$–$C_{18}$-alcohol containing 5 EO. The degrees of ethoxylation mentioned are statistical average values which can be an integer or a fractional number for a specific product. Preferred alcohol ethoxylates exhibit a narrowed distribution of homologues.

In addition, alkyl glycosides can also be used as further nonionic surfactants.

Of the compounds serving as bleaches and donating $H_2O_2$ in water, those which are of particular importance include sodium perborate tetrahydrate and sodium perborate monohydrate. Examples of further useful bleaches are sodium percarbonate, peroxypyrophosphates, citrate perhydrates and salts of peracids or peracids donating $H_2O_2$, such as perbenzoates, peroxophthalates, diperazelaic acid or diperdodecandioic acid. The bleach content of the compositions is preferably 5 to 25% by weight and, in particular, 10 to 20% by weight, the bleach used being advantageously perborate monoydrate.

To obtain improved bleaching when washing at temperatures of 60° C. and below, bleaching activators can be incorporated in the preparations. Examples of these are N-acyl or O-acyl compounds, preferably N,N'-tetraacylated diamines, which, when reacted with $H_2O_2$, give organic peracids, and furthermore carboxylic anhydrides and esters of polyols, such as glucose pentaacetate. The bleaching activator content of the bleach containing compositions is in the customary range, preferably between 1 and 10% by weight, and, in particular, between 3 and 8% by weight. Particularly preferred bleaching activators are N,N,N',N'-tetraacetylethylenediamine and 1,5-diacetyl-2,4-dioxohexahydro-1,3,5-triazine.

The purpose of greying inhibitors is to keep the soils which have been removed from the fiber suspended in the liquor, thus preventing greying of the fiber. Suitable for this purpose are water-soluble colloids, mostly of organic nature, for example the water-soluble salts of polymeric carboxylic acids, glue, gelatin, salts of ether carboxylic acids or ether sulfonic acids of starch or cellulose or salts of cellulose monosulfates or starch monosulfates. Water-soluble polyamides containing acid groups are also suitable for this purpose. Furthermore, soluble starch preparations and starch products other than the ones mentioned above, for example degraded starch, aldehyde starches, and the like can also be used. Polyvinylpyrroli-done is also useful. However, preference is given to using cellulose ethers, such as carboxymethylcellulose, methylcellulose, hydroxyalkylcellulose, and mixed ethers, such as methylhydroxyethylcellulose, methylhydroxypropylcellulose, methylcarboxymethylcellulose and mixtures thereof, for example in amounts of 0.1 to 5% by weight, relative to the compositions.

The foaming power of the surfactants can be lowered or raised by combining suitable surfactant types with one another; a lowering can also be achieved by additions of non-surfactant substances. For use in machine-washing processes, it may be advantageous to add customary foam inhibitors to the compositions. Examples of suitable foam inhibitors include soaps of natural or synthetic origin having a high proportion of $C_{18}$–$C_{24}$ fatty acids. Examples of suitable non-surfactant foam inhibitors include organopolysiloxanes and mixtures thereof with microfine silica which may have been silanated and paraffins, waxes, microcrystalline waxes and mixtures thereof with silanated silica or N,N'-ethylene-bis(stearamide). It is also advantageous to use mixtures of various foam inhibitors, for example those consisting of silicones, paraffins or waxes. The foam inhibitors, in particular those containing silicone or paraffin, are preferably attached to a water-soluble or -dispersible carrier substance.

Suitable enzymes are those from the class of proteases, lipases, amylases, cellulases and mixtures thereof. Enzymatic active substances obtained from bacteria strains or fungi, such as *Bacillus subtilis, Bacillus licheniformis* and *Streptomyces griseus* are particularly suitable. Preferably, proteases of the subtilisin type and, in particular, proteases obtained from *Bacillus lentus* are used. Enzyme mixtures, for example of protease and amylase or protease and lipase or protease and cellulase or protease, amylase and lipase or protease, lipase and cellulase are of particular interest. Oxidases have also proven suitable in some cases. The enzymes can have been adsorbed to carrier substances or embedded in coating substances to protect them against premature degradation. The proportion of enzymes, enzyme mixtures or enzyme granules can be, for example, about 0.2 to about 2% by weight.

In addition, the compositions can contain enzyme stabilizers. For example, 0.5 to 1% by weight of sodium formate can be used. Alternatively, proteases stabilized with soluble calcium salts and a calcium content of, preferably, about 1.2% by weight, relative to the enzyme, can be used. However, it is particularly advantageous to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

The compositions can contain derivatives of diaminostilbenedisulfonic acid or alkali metal salts thereof as fluorescent whitening agents. Examples of suitable compounds are the salts of 4,4'-bis-(2-anilino-4-morpholino-1,3,5-triazinyl-6-amino)stilbene-2,2'-disulfonic acid or compounds of similar structure carrying a diethanolamino group, a methylamino group, an anilino group or a 2-methoxyethylamino group instead of the morpholino group. Further whitening agents of the substituted diphenylstyryl type can be present, for example the alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl. Mixtures of the abovementioned whitening agents can also be used.

The granular detergents and cleaners according to the invention can have a bulk density between about 300 and 1100 g/l. Preference is given to granules having a bulk density above 450 g/l, in particular between 500 and 1100 g/l.

Not only the combinations according to the invention but also the detergents and cleaners according to the invention can be prepared in a manner customary per se, for example by mixing, granulating, extruding and/or spray-drying of an aqueous slurry, followed, if desired, by admixing temperature-sensitive components. In the Is case of the detergents and cleaners, it is possible to use separately prepared builder combinations in the form of a spray-dried or granulated compound as component to be admixed to other granular components of the detergent or cleaner. It is also possible to incorporate the builders and complexing agents in the compositions individually in a manner customary per se and in any desired order.

EXAMPLE

Comparison of the Washing Power

| | % by weight | |
|---|---|---|
| Detergent composition | Detergent according to the invention | Comparison |
| Sodium $C_5$—$C_{11}$-alkylbenzenesulfonate | 7.5 | 7.5 |
| Tallow fatty alcohol sulfate | 4 | 4 |
| $C_{13}$—$C_{15}$ ethoxylated fatty alcohols (7 EO) | 4 | 4 |
| $C_{14}$—$C_{18}$ fatty acid, sodium salt | 2.8 | 2.8 |
| Granulated antifoam | 0.4 | 0.4 |
| Zeolite A | — | 25 |
| Sodium silicate ($SiO_2$:$Na_2O$ = 3.3:1) | 2.6 | 2.6 |
| Sodium carbonate | 9.1 | 9.1 |
| Acrylic acid/maleic acid copolymer | — | 5.5 |
| Carboxymethylcellulose | 1 | 1 |
| EDTA, tetrasodium salt | — | 0.4 |
| Phosphonate (HEDP) | — | 0.5 |
| Fluorescent whitening agent (Trimopal DMS-X) | 0.2 | 0.2 |
| Sodium sulfate | 5.7 | 5.7 |
| Sodium perborate tetrahydrate | 20 | 20 |
| Tetraacetylethylendiamine | 3 | 3 |

-continued

| Detergent composition | % by weight: Detergent according to the invention | Comparison |
|---|---|---|
| Granulated enzyme | 0.5 | 0.5 |
| Tetrasodium iminodisuccinate | 23 | — |
| Sodium polyaspartate Mw 3000 | 6 | — |
| Water | balance to 100% | balance to 100% |

Test Conditions
Washing machine: Miele W 811
Washing method: Single-liquor method
Charge: 3.5 kg of ballast laundry, including test fabric
Chargeliquor: 1:5.7
Temperature: 90° C. wash at the boil program
Water hardness: 18° d (=320 ppm $CaCO_3$ at a Ca/Mg of 5:1)
Dosage: 105 g/machine A stock solution is prepared from the liquid components. The components in powder form are weighed for each wash test and added to the stock solution at the beginning of the washing process.

The following fabric types*) are available from and have been described by Waschmittelforschungsinstitut Krefeld (WFK). The article numbers written next to the fabric type are those registered at WFK for that fabric type.

The following criteria for the washing efficiency of these products should be determined:

Primary washing effect obtained on test fabrics of different soiling

Greying observed on white test fabrics after 25 wash cycles

Soil redeposition on CO 11 A* after 25 washes

Inorganic and organic deposits on CO 11 A* after 25 wash cycles

Damage factor on CO 11 A* (standard cotton according to DIN 53 919, IEC 2267) after 25 washes The washing effect was determined on test fabrics which had been washed together with normally soiled household laundry. The following test fabrics were used:

Wash cycle control ribbon fabric 53 919 G according to DIN 53 919-T2 (article no. 11A)

The greying (including soil redeposition) and inorganic and organic deposits on this fabric are measured after 25 washes.

To measure greying, the following test fabrics are additionally used:

wfk CO terry fabric (article no. 12 A)

wfk PES/CO fabric (article no. 20 A)

These fabric types were included in the wash 25 times and then evaluated by measuring their reflectance in analogy to DIN 44 983-T21.

The bleaching effect is determined by measuring the bleaching intensity BI on the bleaching test fabric after 25 washes in accordance with Section 4.2 of DIN 44 983-T21.

wfk bleaching test fabric (article no. 10 E)

It was determined using the following formula:

$$BI = \frac{c-b}{a-b} \times 100 \text{ (in \%)}$$

a=reflectance value of the undyed, white starting fabric b=mean value obtained from 4 measurements of the unwashed wfk bleaching test fabric c=mean value obtained from 4 measurements of the wfk bleaching test fabric washed 25 times The fabric ash which is an indication of the deposits on the fabric during washing is determined on the cotton standard fabric according to DIN 53 919-T01 after 25 wash cycles in accordance with DIN 44 983 E-T21 (=inorganic deposits). In addition, organic deposits are determined by extraction with methanol.

Furthermore, in each wash, four 40*50 $cm^2$ PES/CO support fabrics were included onto which the following 10*10 $cm^2$ fabric specimens were sewed for evaluation of soil removal:

| | | |
|---|---|---|
| - | wfk CO pigment/Bey skin fat | (article no. 10 C) |
| - | wfk PES/CO pigment/Bey skin fat | (article no. 20 C) |
| - | CFT CO pigment/oil | (article no. AS-8) |
| - | wfk CO cocoa | (articie no. 10-F) |
| - | CFT CO tea | (article no. BC-1) |
| - | CFT CO blood | (article no. CS-1) |
| - | CFT CO pigment/oil/milk | (article no. AS-10) |

The soil-test fabric specimens were washed once, dried and carefully ironed on the left side not designed for measurement until they had become smooth. The cleaning effect was determined by measuring the reflectance on the washed soiled fabrics in analogy to DIN 44 983-T21, Section 4.1. All individual reflectance values measured over the entire experiment were used to calculate the mean value and the corresponding confidence interval for 95% statistical certainty for each fabric type.

4. Test Results 4.1 Results at a water hardness of 3.2 mmol/l (18° d)

The results of the washing effect at a water hardness of 3.2 mmol/l (18° d) are shown in Tables 1 and 2.

TABLE 1

Primary washing results (reflectance values)

| Test fabric | Product: Detergent formulation according to the invention | Comparison |
|---|---|---|
| wfk 10 C | 61.9 ± 0.5 | 61.1 ± 1.8 |
| wfk 20 C | 58.5 ± 0.7 | 57.8 ± 0.6 |
| wfk 10 F | 74.5 ± 0.7 | 73.6 ± 0.4 |
| CFT CS-1 | 53.7 ± 0.5 | 52.1 ± 0.6 |
| CFT AS-10 | 79.5 ± 0.3 | 77.4 ± 0.1 |
| CFT BC-1 | 68.6 ± 0.4 | 66.3 ± 0.3 |
| CFT AS-8 | 68.4 ± 0.4 | 69.0 ± 0.3 |

TABLE 2

Result of the secondary washing effect

| Test fabric | Product: Detergent formulation according to the invention | Comparison |
|---|---|---|
| Bleaching intensity (BI) | 86 | 83 |
| Greying (ΔR) on the following fabrics: | | |
| CO (11A) | 2.7 | 2.7 |
| CO (12A) | 1.5 | 1.5 |
| PES/CO (20A) | 7.7 | 8.0 |
| Soil redeposition (ΔR) on CO (11A): | 1.5 | 1.5 |
| Ash (%) | 2.0 | 3.4 |

TABLE 2-continued

| Result of the secondary washing effect | | |
|---|---|---|
| | Product | |
| Test fabric | Detergent formulation according to the invention | Comparison |
| Damage factor (s) | 0.6 | 0.7 |
| org. deposit (%) | 0,42 | 0.51 |

Although in the detergent according to the invention no EDTA tetrasodium salt and no phosphonate were used for bleach stabilization, the primary washing effect gave the same and, in some cases, better results compared with the standard detergent. The same is true of the bleaching intensity and the soil redeposition.

We claim:

1. A zeolite-free composition, comprising at least one polymer containing recurring succinyl units and/or soluble salts thereof and an iminodisuccinate of the formula

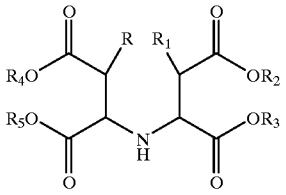

in which

R, $R_1$, independently of one another, denote H or OH, $R_2$, $R_3$, $R_4$, $R_5$, independently of one another, denote hydrogen or an alkali- or ammonium ion.

2. A composition as claimed in claim 1, wherein the iminodisuccinate has the following formula

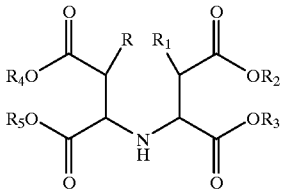

in which

R, $R_1$, denote H or OH, $R_2$, $R_3$, $R_4$, $R_5$, independently of one another, denote a cation, hydrogen, alkali metal ions and ammonium ions, ammonium ions having the general formula $R_6R_7R_8R_9N^+$ and $R_6$, $R_7$, $R_8$, $R_9$, independently of one another, denoting hydrogen, alkyl radicals having 1 to 12 C atoms or hydroxyl-substituted alkyl radicals having 2 to 3 C atoms, and the at least one polymer contains at least one of the following optionally recurring structural units:

A1

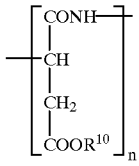

α

B1

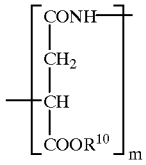

β

I

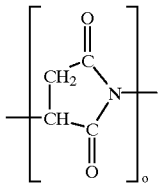

A2

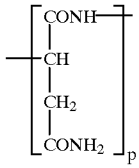

α

B2

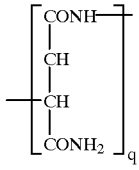

β

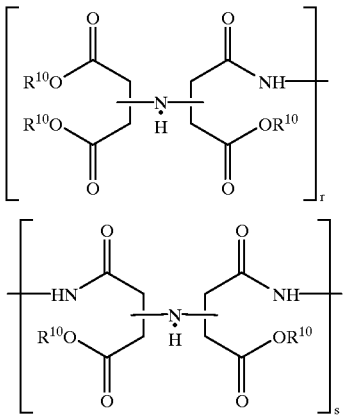

to which the following applies:

$R^{10}$ is H or a cation, n, m, o are 0 or an integer from 1 to 300, p, q are 0 or an integer from 1 to 10, r is 0 or an integer of 1 or 2, s is 0 or an integer from 1 to 10, n+m+o+p+q≦300, the indices n, m, o, p, q, r and s indicating how many units, randomly or non-randomly distributed, are present in the at least one polymer.

3. A composition as claimed in claim 2, wherein the at least one polymer is essentially made up of recurring units A1 and B1 of the formulae

A1

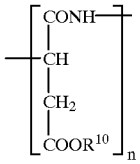

α

-continued

B1

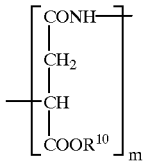

β

4. A composition as claimed in claim 3, wherein at least 50% of units B1, relative to the sum of units A1 and B1, are present.

5. A zeolite-free detergent or cleaner, containing a composition as claimed in claim 1.

6. A detergent or cleaner as claimed in claim 5, which contains, relative to all components present, 0.5 to 40% by weight of the iminodisuccinate and 0.5 to 25% by weight of the at least one polymer containing recurring succinyl units.

* * * * *

UNITED STATES PATENT AND TRADEMARK OFFICE

CERTIFICATE OF CORRECTION

PATENT NO. : 5,977,053

DATED : November 2, 1999

INVENTOR(S) : Groth et al.

It is certified that error appears in the above-identified patent and that said Letters Patent is hereby corrected as shown below:

In Column 14, lines 35-42,

" 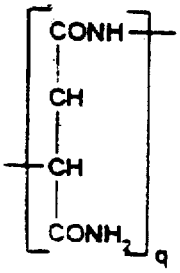 " should read -- 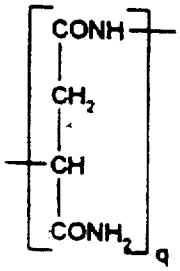 --.

Signed and Sealed this

Fifth Day of September, 2000

*Attest:*

*Attesting Officer*

Q. TODD DICKINSON

*Director of Patents and Trademarks*